United States Patent [19]

Graber et al.

[11] Patent Number: 5,036,967

[45] Date of Patent: Aug. 6, 1991

[54] APPARATUS FOR EXTRACTING BOBBIN TUBES FROM A MAGAZINE

[75] Inventors: Werner Graber, Horgen; Gunter Gartner, Lucerne, both of Switzerland

[73] Assignee: Rieter Machine Works, Ltd., Winterthur, Switzerland

[21] Appl. No.: 331,608

[22] Filed: Mar. 30, 1989

Related U.S. Application Data

[63] Continuation of Ser. No. 74,985, Jul. 17, 1987, abandoned.

[30] Foreign Application Priority Data

Jul. 18, 1986 [GB] United Kingdom ..... 8617615

[51] Int. Cl.[5] ..... B65G 47/90

[52] U.S. Cl. ..... 198/468.2; 294/106; 294/902; 242/35.5 A; 198/803.12

[58] Field of Search ..... 198/468.2, 803.12, 474.1, 198/476.1, 487.1; 242/35.5 A; 414/226, 753; 294/104, 106, 902

[56] References Cited

U.S. PATENT DOCUMENTS

| | | | |
|---|---|---|---|
| 3,176,823 | 4/1965 | D'Errico | 198/468.4 |
| 2,611,493 | 9/1952 | Nordquist | 198/470.1 |
| 3,171,178 | 3/1965 | Smith et al. | 294/104 |
| 3,356,406 | 12/1967 | Renfroe | 294/101 |
| 3,519,305 | 7/1970 | Horstketter et al. | 294/101 |
| 3,667,204 | 6/1972 | Burgermeister et al. | 57/275 |
| 4,162,804 | 7/1979 | Davies | 294/101 |
| 4,403,471 | 9/1983 | Oswald | 198/468.2 X |
| 4,438,623 | 3/1984 | Oswald | 57/275 |
| 4,515,522 | 5/1985 | Sonerud | 294/104 X |
| 4,641,740 | 2/1987 | Grecksch et al. | 198/487.1 |

*Primary Examiner*—D. Glenn Dayoan
*Attorney, Agent, or Firm*—Kenyon & Kenyon

[57] ABSTRACT

The gripper is movable in a path transverse to the bobbin tube supports of the magazine to be aligned with a bobbin tube. The gripper employs gripping elements which engage a limited arcuate accessible portion of a bobbin tube under a force sufficient to extract the tube during movement of the gripper to a retracted position. After release from the gripping elements a transfer chute directs a bobbin tube to a receiving apparatus for subsequent delivery to a machine needing same.

12 Claims, 8 Drawing Sheets

Figure 3:
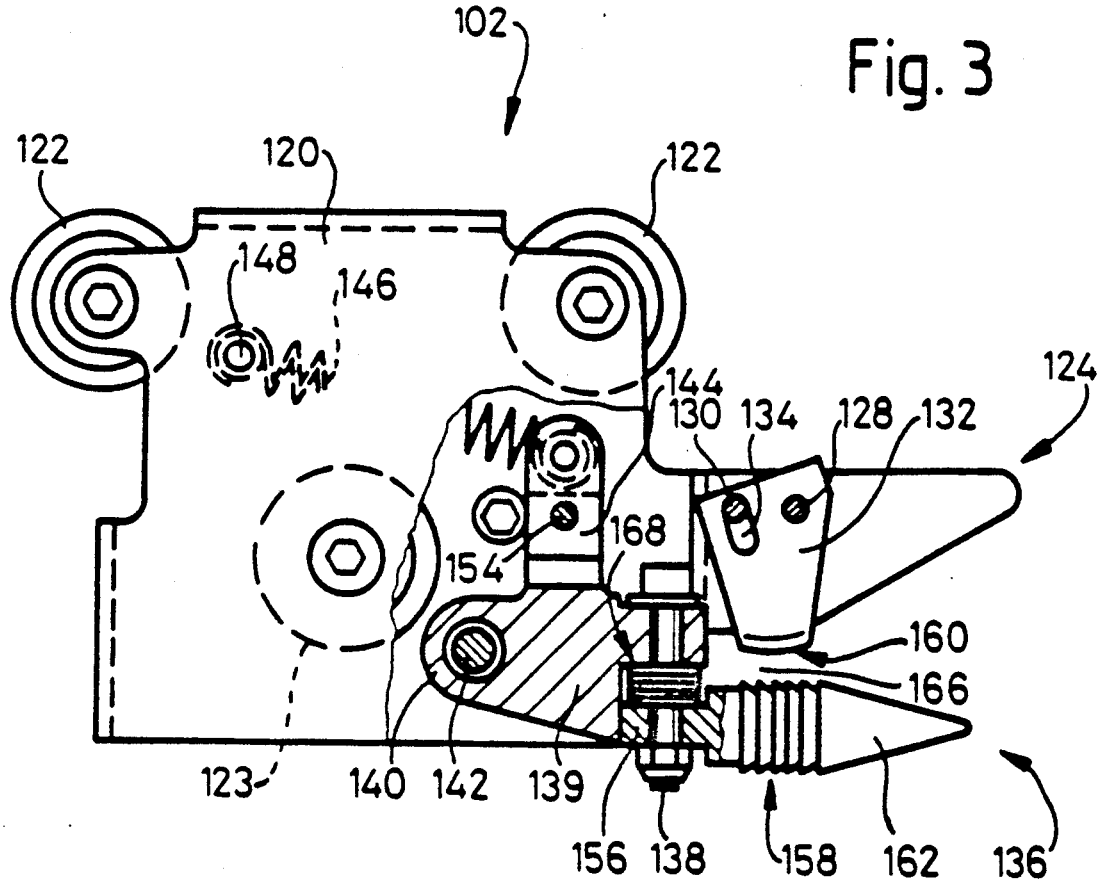

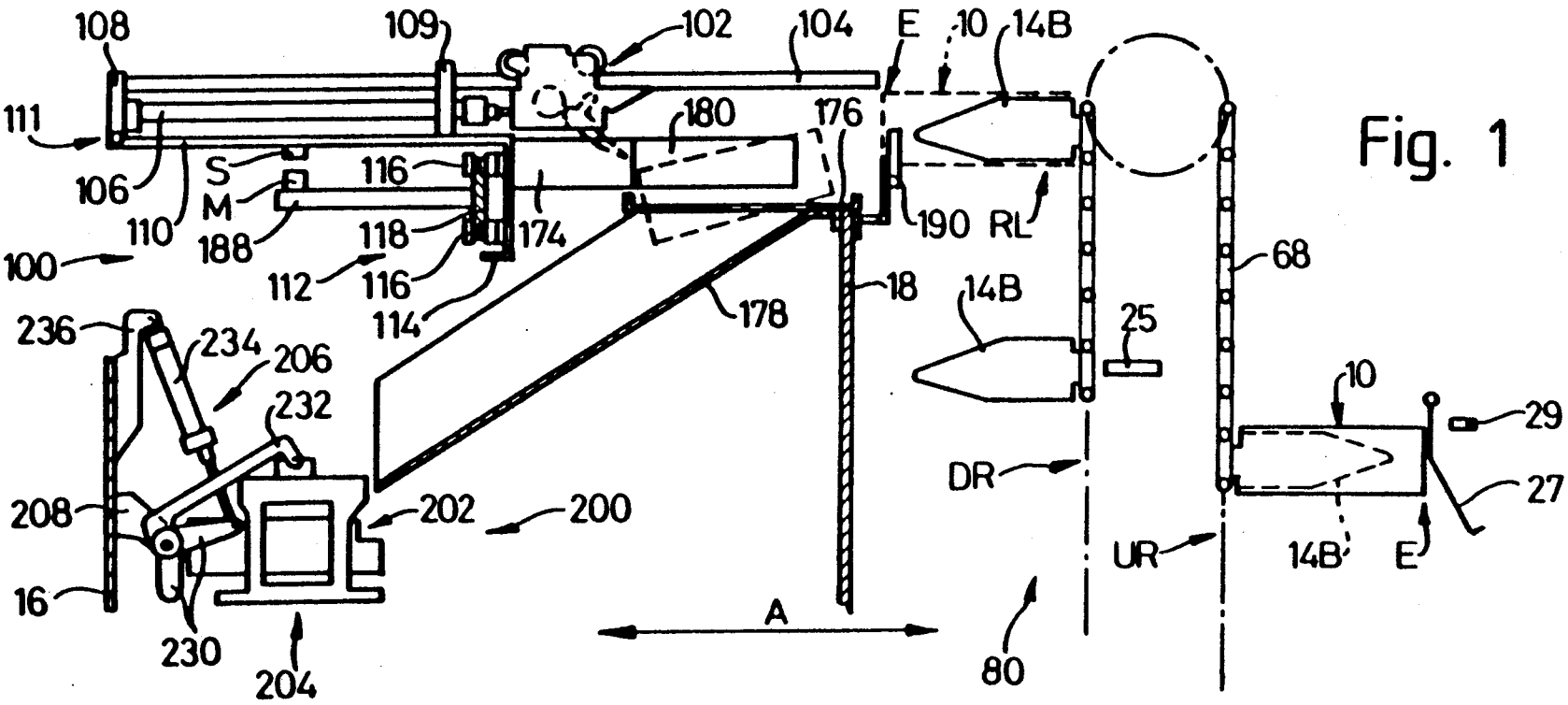
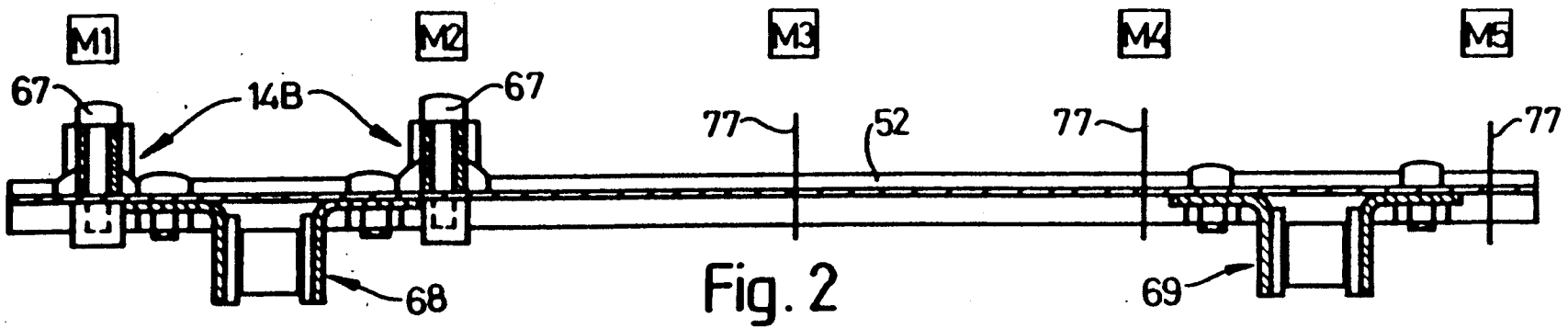
Fig. 2

APPARATUS FOR EXTRACTING BOBBIN TUBES FROM A MAGAZINE

This is a continuation division of U.S. application Ser. No. 07/074,985 filed July 17, 1987 now abandoned.

This invention relates to apparatus for extracting bobbin tubes from a magazine and to a gripper for extracting bobbin tubes. More particularly, this invention relates to arrangements for withdrawing or extracting bobbin tubes from magazines or creels. Arrangements are also provided for transferring extracted bobbin tubes to equipment for further handling thereof.

Steadily increasing efforts are being made to automate the handling of bobbin tubes, upon which yarn packages are wound in, for example rotor spinning machines, backwinding (rewinding) machines for ring spun yarn, jet spinning machines, false twist texturizing machines, and others. Many different proposals have been put forward both as regards the structure of the magazine itself and of the associated bobbin tubes which have been loaded into the magazine. Several examples of such proposals, not all of which have been published prior to the date of filing of the present Application, will be referred to in the course of the description of the drawings. Where appropriate, those prior proposals will be contrasted with the present arrangement.

U.S. patent application Ser. No. 073,810, filed July 15, 1987 describes a detailed structure is disclosed for supporting bobbin tubes individually in or on a magazine or creel.

Accordingly, it is an object of the invention to provide a simple reliable apparatus for extracting bobbin tubes from a conveyor.

It is another object of the invention to provide a gripper of simple construction for removing bobbin tubes from a magazine or creel.

It is another object of the invention to transfer bobbin tubes from a magazine to a bobbin receiving means in a simple manner.

Briefly, the invention provides a gripper for extracting a bobbin tube from a magazine wherein the gripper includes at least one gripper element for entry into a bobbin tube on the magazine, at least a second gripper element for engaging an outer surface of the bobbin tube and resilient means urging the elements toward each other to grip an accessible portion of a bobbin tube therebetween.

The invention also provides an extraction apparatus employing a gripper which is movable between a first and a second position. The gripper is adapted when in its second position to grip a tube by engaging an inner and an outer surface thereof at the accessible end portion. In use, the gripper can then extract the gripped tube from the magazine by movement from its second to its first position.

The invention also provides a combination of such an extraction apparatus with a magazine having a plurality of supports for individual bobbin tubes. The combination can include means for causing relative movement of the gripper and the supports in order to bring the gripper into operative alignment with a selected support. In the preferred embodiment, the means for causing relative movement of the gripper and the supports comprises mean for causing both movement of the supports within the magazine and movement of the gripper relative to the magazine, in addition to the movement of the gripper between its first and second positions.

In the preferred embodiments, the arrangement is such that the gripper takes up a bobbin tube automatically in moving from its first to its second position, provided the bobbin tube has been appropriately prelocated relative to the second position of the gripper. The gripper may also be arranged to release a gripped bobbin tube automatically during movement from the second to the first position, after completing withdrawal of the bobbin tube from the magazine. This automatic release is preferably effected due to mechanical engagement of parts during the movement of the gripper to its first position.

Transfer means may be provided to transfer extracted bobbin tubes to further handling equipment. The transfer means may be arranged to receive bobbin tubes successively. There may be only a single gripper associated with a magazine comprising a plurality of supports, and the apparatus may be adapted to bring an extracted bobbin tube to the transfer means regardless of the position within the magazine from which the tube was extracted.

The transfer means may be arranged to transfer an extracted tube initially by movement thereof along its own axis. However, means may be provided to convert this mode of movement of an extracted tube into movement thereof at right angles to the tube axis. Means for converting the mode of movement of an extracted tube may be selectively operable to release a received tube only in response to a predetermined signal indicating a demand for a tube from further handling equipment.

Figure 4:
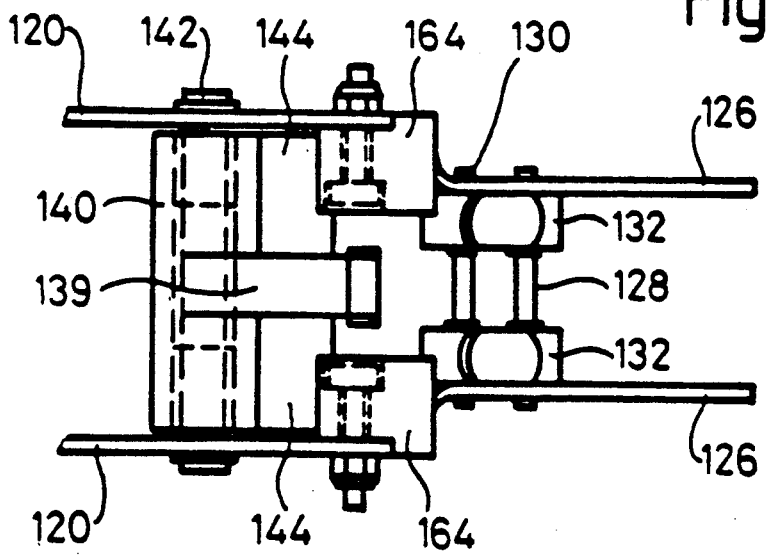
Figure 5:
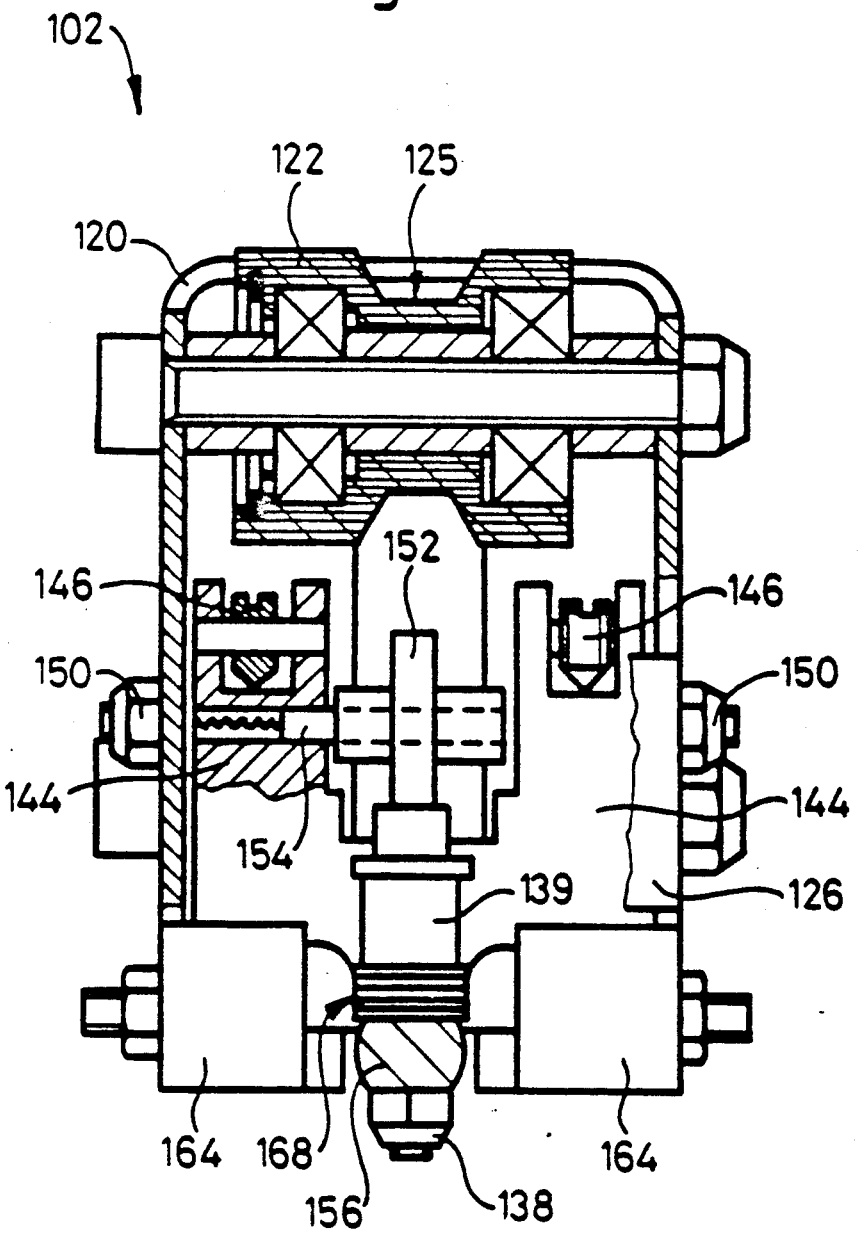
Figure 6:
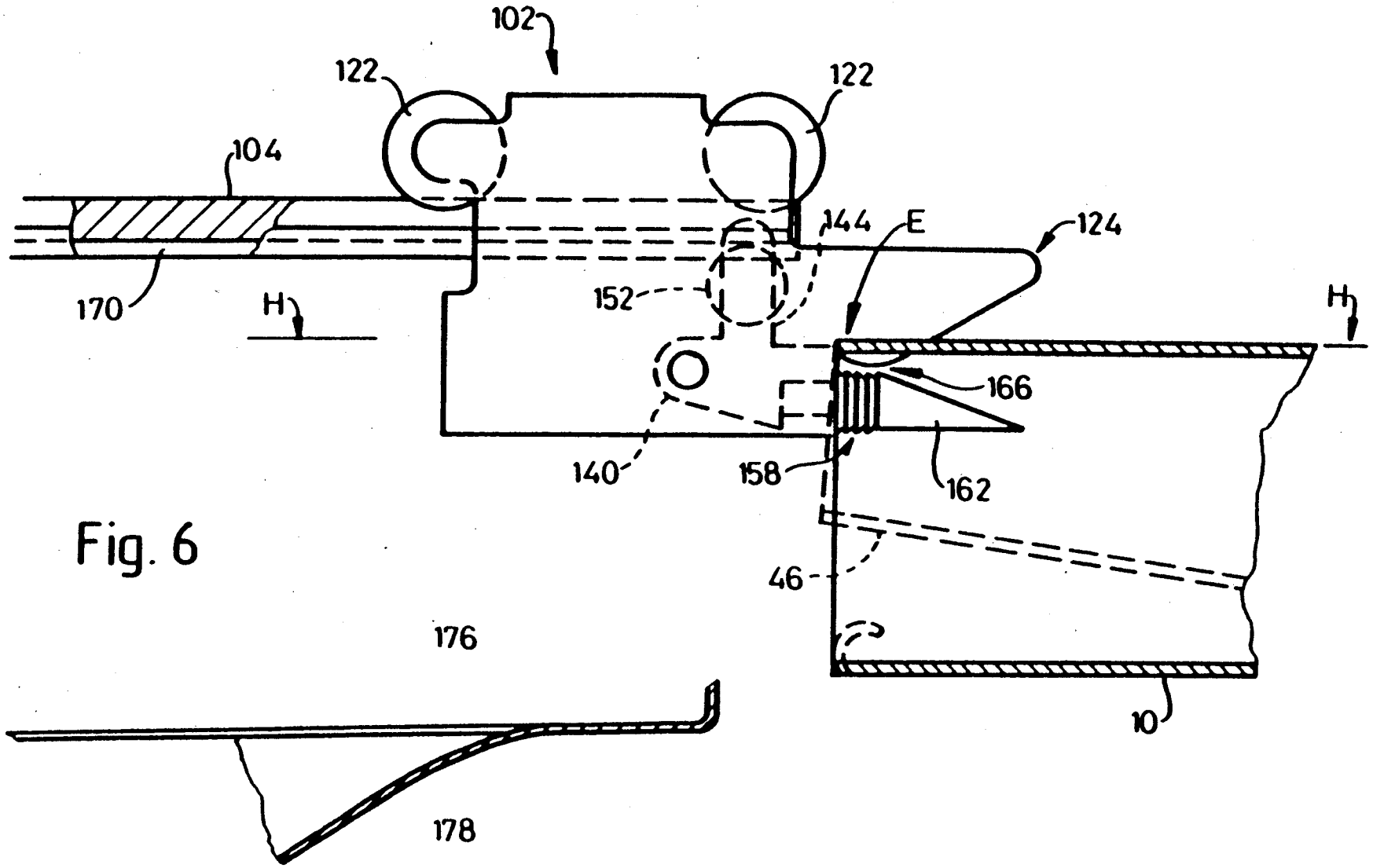
Figure 7:
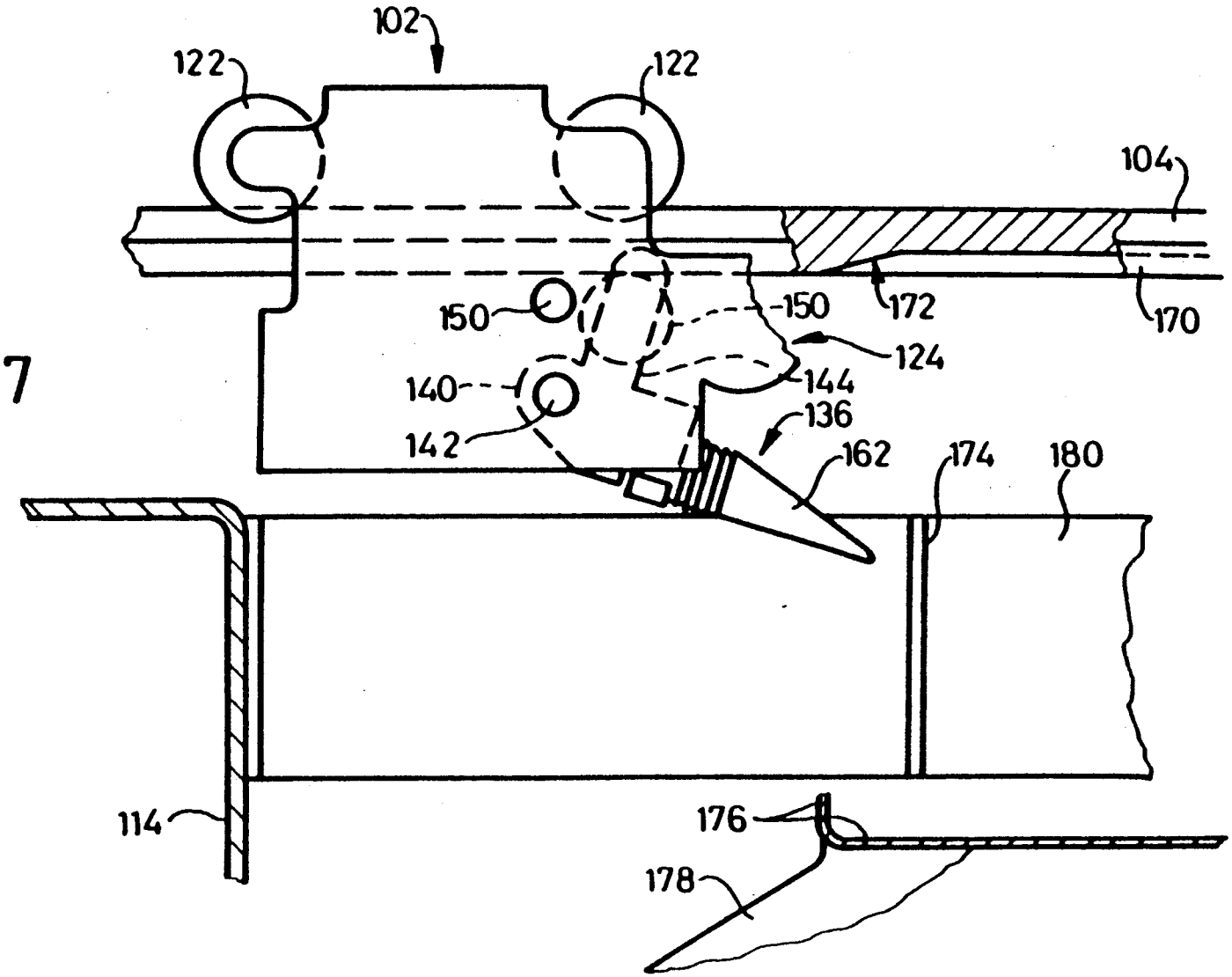
Figure 8:
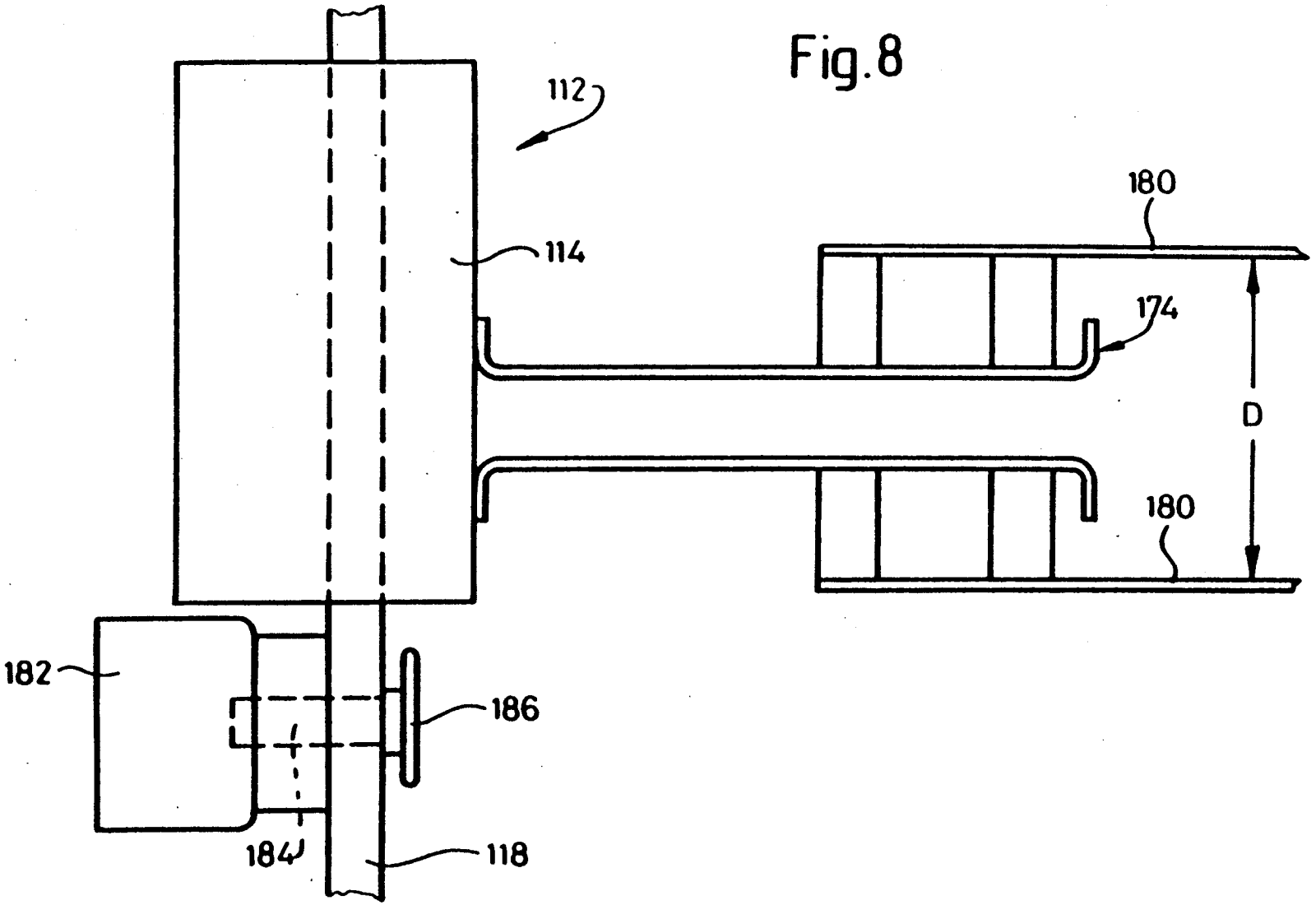
Figure 9:
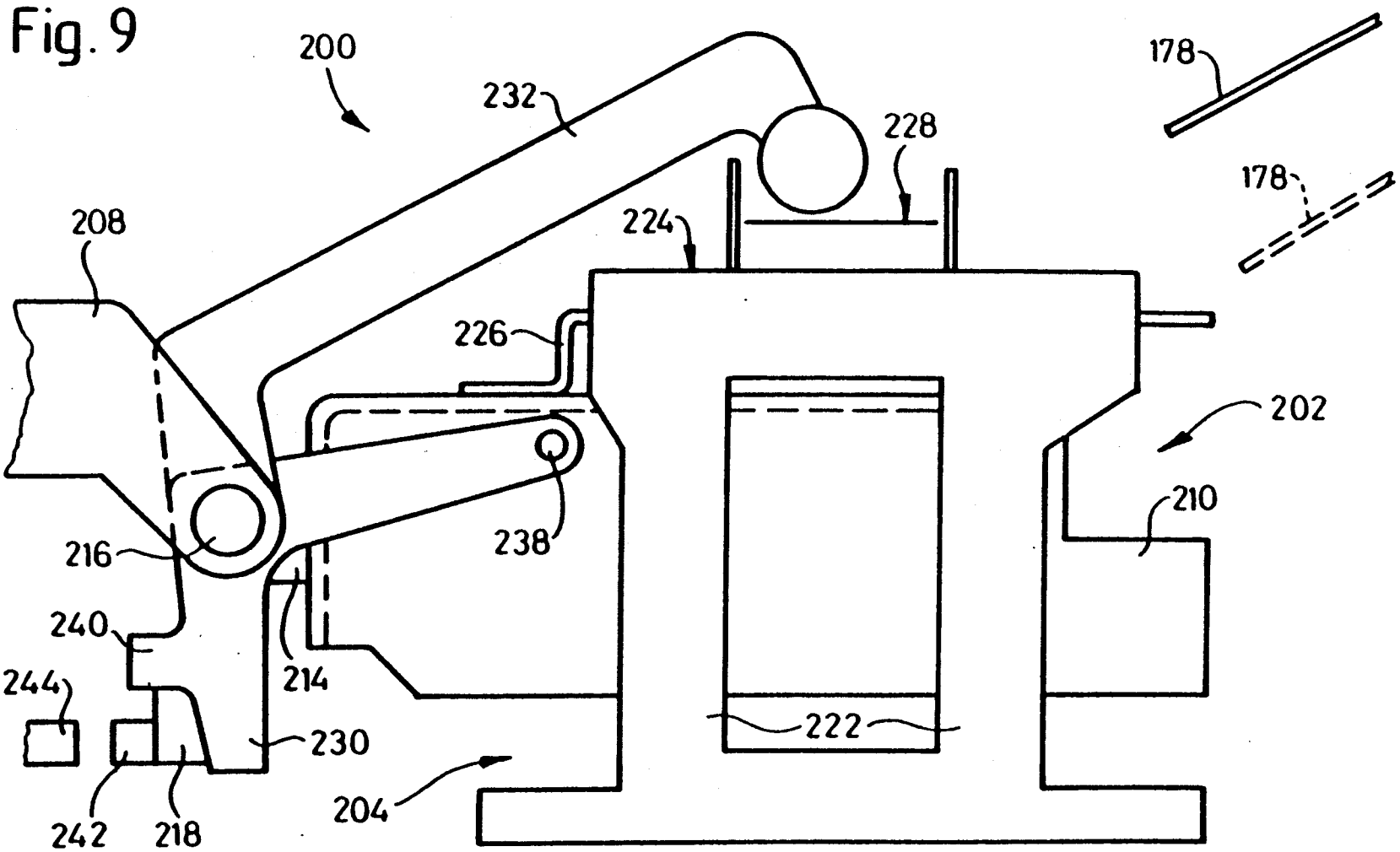
Figure 10:
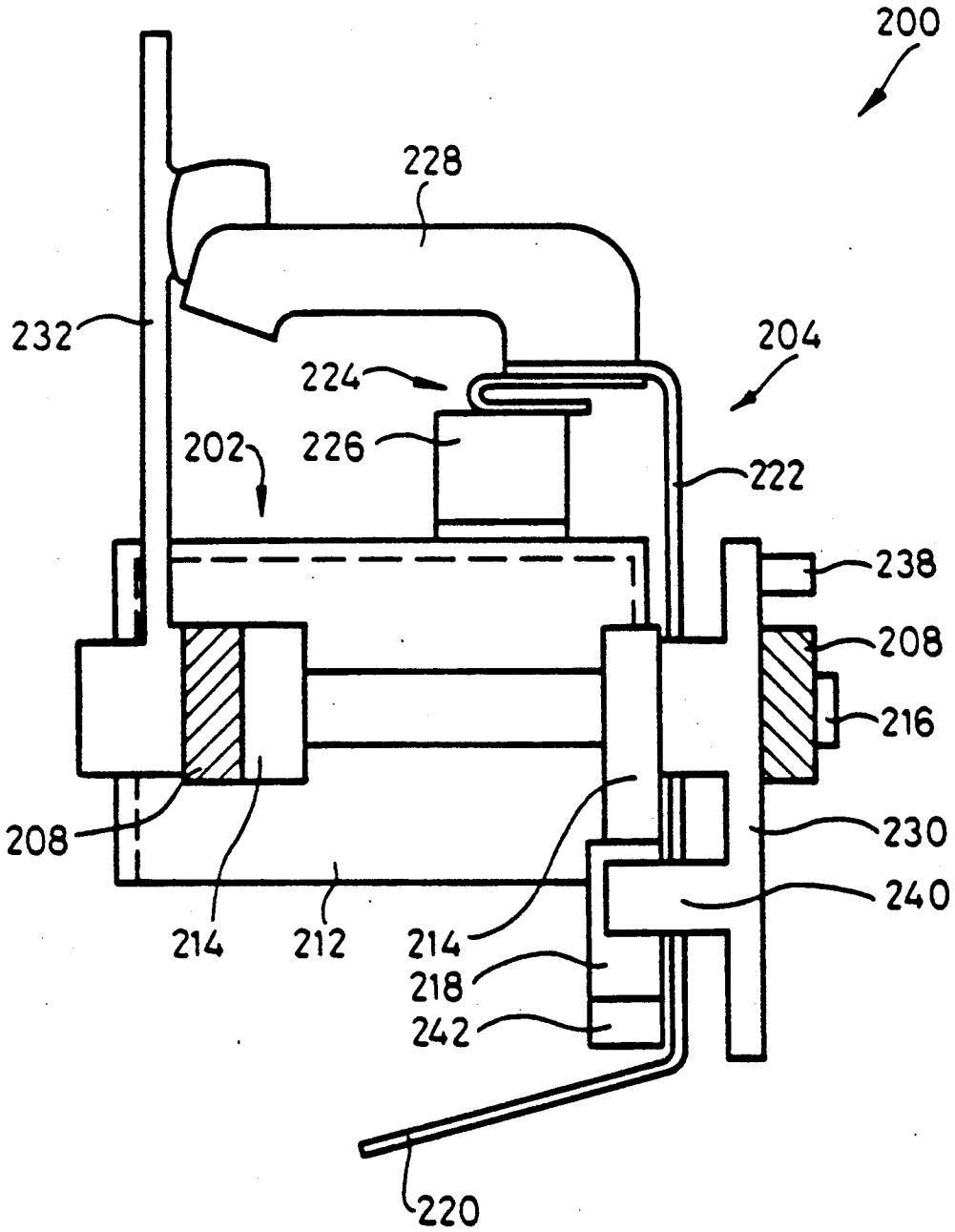

By way of example, one embodiment of an apparatus in accordance with the invention will now be described with reference to the accompanying drawings, in which FIG. 1 is a diagrammatic side elevation of part of a bobbin tube magazine together with a bobbin tube extracting apparatus in accordance with the invention and tube receiving equipment, FIG. 2 is a diagrammatic plan view, illustrating a detail of the magazine shown in FIG. 3 is a side elevation of a gripping device used in the arrangement of FIG. 1, FIG. 4 is a partial underplan of the device shown in FIG. 3, with some elements broken away to illustrate others more clearly, FIG. 5 is a front elevation of the device shown in FIG. 3, drawn to a larger scale and with some elements broken away, FIG. 6 is a side elevation showing the device of FIG. 3 in a position to grip the end of a tube in the magazine of FIG. 1, FIG. 7 is a view similar to FIG. 6 (but with part broken away), showing the gripping device releasing the tube after withdrawing it from the magazine, FIG. 8 is a plan view of part of the apparatus shown in FIG. 1, FIG. 9 is a side elevation showing the tube receiving equipment of FIG. 1 in greater detail, and FIG. 10 is an end elevation of the parts shown in FIG. 9.

ASSOCIATED PATENT APPLICATIONS

The arrangement shown in FIG. 1 is intended for use in a travelling service tender for rotor spinning machines as described, for example, in published European Patent Applications Nos. 126,352; 126,373 and 127,017. However, many other forms of travelling service tenders for textile yarn processing have also been known.

The arrangement shown in FIG. 1 essentially comprises three sections, namely a bobbin tube magazine generally indicated by the numeral 80, a bobbin tube extraction apparatus generally indicated by the numeral 100, and a bobbin tube receiving means generally indicated by the numeral 200 and arranged (as will be described) to receive bobbin tubes extracted from the magazine 80 by the extracting apparatus 100.

The complete illustrated arrangement is mounted upon a travelling service tender, as referred to above, the remainder of the tender being represented in FIG. 1 simply by two vertical plates 16, 18 respectively. The tender is movable, for example, as described in European Patent Application No. 126,373, selectively in opposite directions relative to the non-illustrated textile processing machine, those directions being represented in FIG. 1 by the double-headed arrow A. Plate 18 may be an end plate of a main frame of the tender, this plate extending at right angles to the directions of movement A. Magazine 80 may be mounted on plate 18, for example by a hinge device (not illustrated) as disclosed in U.S. Pat. No. 4,655,665. This is not essential; magazine 80 could be supported separately from the tender, but connected to the latter so as to be moved with the tender in the directions A. It is to be noted, however, that the embodiment to be described relates specifically to an arrangement in which the tube magazine is provided on or in close association with the tender, rather than to a bobbin tube magazine disposed at a fixed position relative to the path of movement of the tender.

Tube magazine 80 is preferably formed in accordance with the above noted copending patent U.S. application Ser. No. 073,810. The full disclosure of that copending Application is incorporated into the present specification by reference. A magazine 80, in accordance with one of the embodiments illustrated in the copending Application, will be assumed in the following description, but only brief details of the magazine structure will be provided here. In the immediately following brief description of the magazine structure, the reference numerals used will correspond as far as possible with those used to indicate similar parts in the copending application.

Magazine structure 80 comprises a pair of chains, one of which is partly indicated at 68 in FIG. 1, the second chain being indicated at 69 in FIG. 2. Chains 68, 69 are supported, and driven in synchronism, by upper and lower sprockets; the lower sprocket is not illustrated in FIG. 1, but the upper sprocket is indicated diagrammatically in chain-dotted line. Carrier bars, one of which is indicated at 52 in FIG. 2, are secured to aligned links of chains 68, 69, so that each bar 52 extends horizontally between the chains. The sprockets are so arranged that the bars are carried around a closed conveying path having vertical runs indicated at DR and UR respectively. The normal direction of drive is such that the bars 52 move downwardly on run DR and upwardly on run UR. This normal direction of drive could be in the reverse direction if required.

Each bar 52 carries a plurality of bobbin tube supports 14B. Each tube support is indicated in outline only in FIG. 1, but is formed in accordance with the embodiment described with reference to FIG. 6 of the copending Application, and is adapted to receive and support an individual cylindrical bobbin tube such as the tubes 10 indicated in FIG. 1. In FIG. 2, which is a copy of FIG. 5 of the copending Application, the mounting portions (including bolt 67) of two supports 14B are shown adjacent chain 68. The positions of three other supports carried by bar 52 are indicated simply by the center lines 77 of their respective fixing bolts 67. Details of the mountings can be found from the copending Application; in the present context, only the distribution of the supports 14B along the bar 52 is important, although the illustrated number and distribution of supports is given by way of example only.

Each support 14B extends cantilever-fashion away from its carrier bar 52 and has a free end over which a tube 10 can be pushed in order to mount it on the support. As shown in FIG. 1, when fully mounted on a respective support 14B, a tube 10 projects axially beyond the support to present a free or accessible edge at one end thereof. The non-illustrated drive system normally moves the bars 52 around the conveying path to bring them in succession into a removal location RL at the upper end of the downward run DR; at this location, the tubes 10 project from the respective carrier bar 52 towards the apparatus 100.

As described in the copending application, each support 14B is adapted to exert a retaining force on a tube mounted thereon to resist movement of the tube axially of the support. The retaining force is at least sufficient to prevent the tube 10 falling away from its support under its own weight, for example, as the associated carrier bar 52 moves from the downward run to the upward run of the conveyer path. Accordingly, at the start of a given operating period, the magazine can be fully loaded (with a tube 10 on each support 14B), and the arrangement can be left to operate automatically with the bars 52 being brought in succession to the removal location RL.

Clearly, removal of a tube 10 from the magazine 80 will involve movement of the tube longitudinally of its own axis off the associated support 14B. This means that the retaining force exerted on the tube 10 to resist such movement must be overcome by the removing means. There are a number of possibilities for such a means. For example, levers, such as those shown in U.S. Pat. No. 4,641,740, could be arranged to act upon the "inner" edge of tube 10, i.e., the edge of tube 10 adjacent carrier bar 52. However, this implies that the extracting levers extend into the magazine 80 between supports 14B and tubes 10 carried thereby. Alternatively, where a support 14B does not fill the complete cross section of a tube carried thereby, a retractable extractor element could be extended through the bore of tube 10 to engage behind the "inner" edge thereof and withdraw the tube from the magazine 80 upon retraction of the extractor element. This will necessitate separation of tube 10 from the extractor element after removal thereof from the magazine. In the preferred arrangement, therefore, the bobbin tube extracting apparatus 100 operates upon the "outer" edge of a tube 10, i.e., the edge remote from carrier bar 52.

In the embodiment to be described subsequently, a portion of a tube 10 adjacent the "outer" edge thereof is gripped between gripper elements cooperating respectively with the internal and external peripheral surfaces of the tube. The magazine 80 must be arranged so that the relevant edge portions of the tube 10 are brought into the correct locations for gripping by the withdrawal apparatus 100. For this purpose, a sensor 25 is provided to ensure that the chains 68, 69 are stopped with a carrier bar 52 correctly located at the removal location RL; a suitable sensor for this purpose is shown in the prior applications referred to above, but alternative sensors will be readily apparent to those skilled in the conveyer control art. A pivotable flap, diagrammatically indicated at 27, is provided to ensure that tubes 10 have been pressed over their respective supports 14B to an extent sufficient to ensure adequate support and location by those supports. Flap 27 is pivoted at its upper end as viewed in FIG. 1, and is illustrated in its normal position. If the outer ends of tubes 10 pivot flap 27 in an anti-clockwise direction as viewed in FIG. 1 to an unacceptable extent, this is sensed by sensor 29 which stops operation of magazine 80 and provides an alarm signal, indicating that correction is required.

Removal apparatus 100 is designed to cooperate with the uppermost portion E of the outer edge of tube 10 at the removal location RL. If the tubes 10 are correctly mounted upon their respective supports 14B, as described above, then the cooperation between the supports and the tubes will ensure that the edge portions E at the removal location RL are correctly located for cooperation with the removal apparatus, as described in the copending application. Only cylindrical tubes 10 are shown in FIG. 1; however, the tube supports in magazine 80 can be modified (as described in the copending application) to receive conical, or tapered bobbin tubes and, as will be described with reference to FIG. 6, the modification can be such that no associated change is required in the extraction apparatus 100.

TUBE WITHDRAWAL

In the illustrated example, assuming for the present that each support 14B carries an associated bobbin tube 10, a row of five bobbin tubes 10 will be presented to the extraction apparatus 100 each time a carrier bar 52 is moved into the removal location RL. The extraction apparatus to be described is designed to remove tubes 10 from the magazine 80 individually, i.e., one at a time.

Apparatus 100 comprises a gripper carriage 102 (to be described in greater detail later), a guide rail 104 for guiding linear reciprocating movement of the carriage 102 towards and away from magazine 80, and a double acting piston and cylinder unit 106 for causing back and forth movement of carriage 102 on rail 104. Rail 104 and unit 106 are carried at one end by a support 108, which is pivotally mounted (as indicated at 111) on a platform 110. The latter is mounted upon a second, linearly-reciprocable carriage, generally indicated at 112, and comprising a support plate 114 and rollers 116, running on a rail 118 extending at right angles to rail 104.

Platform 110 also carries a support and guide member 109 having a slot (not shown) through which rail 104 and unit 106 extend. The lower end cf this slot limits downward movement of rail 104 and unit 106, while leaving those parts free to pivot upwards if support 108 pivots in an anti-clockwise direction (as viewed in FIG. 1) about mounting 111. The purpose of this arrangement will be described later.

It will be readily appreciated that movement of carriage 112 along its rail 118 can bring rail 104 and gripper carriage 102 into alignment with any selected one of the tubes 10 at the removal location RL, while movement of carriage 102 back and forth along rail 104 enables the gripper device (to be described) on carriage 102 to draw the selected tube 10 out of the magazine 80 by movement along the tube axis. The following description will concentrate firstly upon the tube withdrawal movements performed by gripper carriage 102, and it will initially be simply assumed that carriage 112 has been correctly located on rail 118 in order to bring rail 104 into axial alignment (as viewed in plan, not shown) with the selected tube 10. At a later stage, the description will proceed to control of movements of the carriage 112 and transfer of the extracted bobbin tube to the receiving apparatus 200.

As is seen in FIGS. 3 to 5, gripper carriage 102 comprises a sheet metal body 120, carrying a pair of rollers 122 which run on the upper side of rail 104 (FIG. 1) and a single roller 123 which runs on the lower side of that rail. Although not specifically illustrated in the figures, rail 104 is hexagonal in cross section and rollers 122, 123 have appropriate grooves, as illustrated at 125 for the rollers 122 in FIG. 5, to cooperate with the rail cross section and locate carriage 102 against rotational movement around the rail axis.

The front of body 120 (i.e., the surface facing magazine 80) is open and the body is formed with a forwardly-projecting nose 124 (FIG. 3) made up by two side plates 126 (FIG. 4) extending forwardly from respective side walls of the body 120. Side plates 126 support between them a pivot pin 128 and a stop pin 130. Pivot pin 128 supports a pair of gripping shoes 132 disposed adjacent respective side plates 126 (see FIG. 4). Each shoe 132 has a slot 134 (FIG. 3) receiving the stop pin 130.

Shoes 132 are illustrated in FIGS. 3 and 4 in their "normal", non-gripping positions in which the stop pin 130 engages the upper end of slot 134 as viewed in FIG. 3. The shoes are biased into these positions by non-illustrated resilient means such as torsion springs. Each shoe is individually pivotable from its illustrated position in a clockwise direction about the axis of pivot pin 128 until stop pin 130 is engaged by the lower end of slot 134 as viewed in FIG. 3. The purpose of this arrangement will become apparent from the subsequent description of the gripping operation.

Shoes 132 represent "outer gripping elements" which engage the external surface of the botbin tube 10 to be gripped. An "inner gripping element", to engage the internal surface of the bobbin tube 10, is indicated generally at 136. Element 136 is secured by a fixing screw 138 to lug 139 on a rocker 140 which can rotate about the axis of a pin 142 mounted between the side walls of body 120. Rocker 140 extends along the whole length of pin 142 between the side walls of body 120, but lug 139 and element 136 are relatively narrow and are provided on the central portion of rocker 140 so as to extend between the two gripper shoes 132 when viewed in plan—this is indicated by the position of lug 139 in FIG. 4, but part of the lug and the whole of element 136 have been omitted from that figure to show the other parts clearly.

Rocker 140 has a pair of integral, upstanding arms 144, located adjacent respective side walls of body 120 (see FIG. 5). At its upper, free end, each arm 144 is connected to a respective tension spring 146 (FIGS. 3 and 5), the other end of which is secured (for example by a pin 148, FIG. 3) to the body 120. Tension springs 146 tend to rotate rocker 140 in an anti-clockwise direction (as viewed in FIG. 3) about pin 142, thereby tending to draw element 136 towards nose 124 and the gripping shoes 132 carried thereby. Movement of element 136 towards shoes 132 is limited by engagement of arms 144 with respective stops 150, mounted in the side walls of body 120.

A roller 152 (FIG. 5, not shown in FIG. 3) is disposed between the arms 144 and is rotatably mounted on the arms by means of a pin-shaft 154. When roller 152 engages a suitable abutment (to be described later) rocker 140 rotates clockwise (as viewed in FIG. 3) about pin 142. In this way, element 136 can be moved away from nose 124 and gripper shoes 132.

Element 136 comprises a mounting portion 156, secured by screw 138 to rocker 140, a gripping section 158 aligned (as viewed in FIG. 3) with gripping surfaces 160 on shoes 132, and a conical tip 162 at its forward, or leading, end. Tip 162, and also the underside of nose 124 formed by the leading edges of plates 126, act as guides for an edge portion E (FIG. 1) of tube 10 entering or leaving the nip 166 formed between shoes 132 and the gripper section 158 of element 136. The dimensions of the nip 166 can be adapted to the wall thickness of tube 10 by adjusting the position of element 136 laterally of its own axis towards or away from nose 124. For this purpose, spacing washers 168 are provided between lug 139 and mounting portion 156 of element 136, the number of washers 168 being adjusted in dependence upon the wall thickness of the tube to be gripped. In this way, the device can be adapted to accomodate even tubes with "curled-over" ends as will be shown in FIG. 6.

Gripper carriage 102 is illustrated in FIG. 3 in a "ready" condition in which it is ready to receive the edge portion E (FIG. 1) of a selected tube 10. Carriage 102 adopts this "ready" condition during movement along rail 104 from its retracted position (illustrated in FIG. 1) towards the removal location RL of magazine 80. In this ready condition, springs 146 draw arms 144 back against their respective stops 150, and the non-illustrated torsion springs pivot shoes 132 about pin 128 until the stop pin 130 engages the upper ends of the slots 134. This is the condition giving closest approach of the gripping surfaces 160 on shoes 132 to the gripping section 158 on element 136 for the given, pre-selected packet of spacing washers 168.

As the extension of piston and cylinder unit 106 is continued, causing continued movement of carriage 102 to the right as viewed in FIG. 1, the edge portion E of tube 10 will probably first engage either the leading edges of plates 126 (FIG. 4) or the uppermost surface on tip 162. In either case, edge portion E is guided into the nip 166. Forward movement of carriage 102 is continued until the edge portion E engages two resilient cushioning blocks 164 (FIGS. 4 and 5) secured to respective side walls of body 120. It will be clear that the edge portion E referred to here is not simply the highest point on the outer tube edge, but is a short arc (including the highest point) on that edge.

As the outer edge of tube 10 engages the shoes 132, it pivots then in a clockwise direction, as viewed in FIG. 3, about the support pin 128 against the bias provided by the non-illustrated springs. This movement is permitted by slots 134 receiving stop pin 130. The geometry of the system is such that this pivotal movement of each shoe 132 carries its respective clamping surface 160 slightly further away from gripping section 158 of element 136, thus slightly increasing the dimensions of nip 166 and facilitating entry of the tube into the nip. This entry is also facilitated by the form of gripping section 158, which (as seen in FIG. 3) comprises a series of frustoconical rings, each of which converges in the forward direction along element 136. As viewed in side elevation, therefore, gripping section 158 presents a series of serrations, which facilitate entry movement of the tube into the nip, but tend to resist exit movement of the tube out of the nip. The above-mentioned springs urge the shoes continually into contact with tube 10 so that it is clamped between the shoes and section 158 of element 136.

Any tendency for the tube to move back out of the nip (to the right as viewed in FIG. 3) will tend to cause pivotal movement of shoes 132 in an anti-clockwise direction as viewed in FIG. 3 about the support pin 128, i.e., back towards the position actually illustrated in FIG. 3. This "eccenter" action of shoes 132 will tend to increase the gripping force applied between the shoes and the element 136 to resist movement of the tube out of the nip. By suitable adjustment of the spacing washer packet 168, the gripping force applied between shoes 132 and element 136 can be made sufficient to overcome the retaining force exerted on the tube by the magazine structure 80, so that as carriage 102 is moved back towards its retracted position, it draws the gripped tube 10 axially of the length of the tube off the associated support 14B.

FIG. 6 is actually a composite of two drawings which have been superposed in order to facilitate explanation of certain physical relationships. For reasons which will be clear from the following description, the apparent conditions in this Figure could not arise in practice.

In FIG. 6., the carriage 102 is shown in its full-forward position in the absence of a tube 10 at the corresponding magazine position. The carriage is illustrated mainly in outline, much of the details shown in FIG. 3 being omitted, so that certain other aspects of the operation can be highlighted. Also, in FIG. 6, a sectioned, cylindrical tube 10 is illustrated in full lines in its "waiting" position, i.e., before contact with the carriage 102. Tube 10 is illustrated in an "ideal" condition in which its external surface just contacts an imaginary horizontal plane H at right angles to the plane of the figure.

As can be seen from FIG. 6, this plane H lies slightly above the nip 166 of the fully extended carriage 102, so that the portion E of the outer edge of tube 10 ideally engages the leading edge of nose 124 as the carriage 102 moves into the illustrated position. Due to the pivotal mounting 111 of the support 108, and the freedom for upward movement provided by the non-illustrated slot in support 109, nose 124 is free to ride upwards on the edge portion E of tube 10—the tube end of course also being depressed slightly under the weight of the carriage and associated tilting structure.

The same carriage 102 is arranged to operate on tapered or conical tubes, indicated in dotted lines at 46, of the same axial length as cylindrical tubes 10. This is so because the tube supports in magazine 80 for conical tubes 46 are arranged to hold those tubes so that, in the "ideal" condition, they also just contact the horizontal plane H. If the tube (10 or 46) does not lie exactly in the ideal position, support 108 may tilt to a greater extent, or the tube end may be forced up by engagement with tip 162. The system is preferably set up to avoid the latter operation whenever possible.

As shown in FIG. 6, when carriage 102 is fully extended, after completion of a gripping operation, rocker 140 is still drawn by springs 146 (FIG. 3) so that arms 144 contact stops 150 (FIG. 3). Any required adaptation of the nip dimensions to tube wall thickness tolerances is enabled by the eccentric operation of gripper shoes 132 as described above. At this stage of operation, roller 152 is received in a groove 170 provided in the underside of rail 104. Roller 152 does not contact the rail 104, and therfore does not interfere with the action of springs 146 on rocker 140. This condition is maintained until carriage 102 approaches its retracted position, now to be described with reference to FIG. 7, so that the tube 10 or 46 is subjected to the full gripping effect throughout the return movement of the carriage.

Just before the carriage reaches its fully retracted position (FIG. 7, and also FIG. 1), the depth of groove 170 decreases rapidly so that roller 152 runs first onto the curved surface 172 in the groove, and then on to the downwardly-facing external surface of rail 104. The roller 152 acts as a means for moving the gripping elements 124,136 apart to release a tube. To this end, the roller 152 forces arms 144 away from stop 150, against the bias applied by springs 146, and hence pivots rocker 140 around pin 142. Inner gripping element 136 is moved downwardly away from gripping shoes 132 (FIG. 3) so that there is no longer any clamping nip between the gripping elements. Just after the tilting movement of rocker 140 commences, the lower portion of the leading end of tube 10 or 46 strikes against a stop 174 (FIG. 7 and FIG. 8.) which is secured to project forwardly from the support plate 114 in carriage 112 (see also FIG. 1). At this stage, the gripping device has already released the tube, so that the latter remains in engagement with the stop 174 as carriage 102 completes its return movement to the fully retracted position (FIG. 7), thereby with drawing element 136 from the interior of the previously gripped tube. The previously-gripped edge portion of the tube slides down the tapered surface of tip 162. FIGS. 6 and 7 illustrate a tip form which is slightly modified relative to that of FIG. 3, but the principle involved is the same for both.

Stop 174 is spaced sufficiently far away from magazine 80 to ensure that the tube 10 or 46 has been withdrawn completely from the magazine before it engages the stop. In fact, when the leading end of the tube engages stop 174, the tube lies above a receiver plate 176, onto which the tube falls when it is dropped by the gripper device.

From the plate 176, the tube must be passed to a transfer chute 178 in the form of an inclined slide. Chute 178 is wide enough to receive only a single bobbin tube, and is aligned with the middle support 14B on the carrier bar 52 at the removal location RL. Plate 176 has an opening immediately above chute 178 so that when a withdrawn tube is aligned with the chute 178, only a short length of that tube adjacent its trailing end is supported by plate 176. The leading end accordingly falls through the opening, as indicated in dotted lines in FIG. 1, and slides down chute 178. Since this is a pure sliding movement of the tube along its own axial length, without any rolling thereof, this transfer operation can be the same for both cylindrical and conical tubes.

Clearly, a tube withdrawn from the middle support 14B of a bar 52 passes directly to the chute 178 when it is dropped by the carriage 102, only the trailing end of such a tube coming into contact with the receiver plate 176. On the other hand, tubes withdrawn from the other supports 14B come to rest completely on the plate 176 and have to be moved into alignment with the chute 178, and the associated opening in the receiver plate. For this purpose, the stop 174 carries a pair of lateral guides 180 (partly illustrated in FIG. 8, also shown in FIG. 1), so that a tube resting on plate 176 lies between these lateral guides which are spaced by distance D (FIG. 8) only slightly greater than the (maximum) external diameter of the withdrawn tube.

At the completion of one withdrawal operation, carriage 112 always returns to a starting position aligned with the opening in plate 176. If the withdrawal operation was performed for a tube on the central support 14B of bar 52, then no adjustment is required in positioning of carriage 112 at the completion of that withdrawal operation. If, however, the tube is withdrawn from one of the other supports 14B, then the return of carriage 112 to the central, starting position causes guides 180 to roll the withdrawn tube along plate 176 into alignment with the opening therein, and the chute 178. Since the withdrawn tube is closely confined laterally between guides 180 throughout this rolling movement, the action can be the same for both cylindrical and conical tubes.

The arrangements for moving carriage 112 along rail 118 have been indicated schematically in FIG. 8. The rail itself is fixed relative to the main frame of the service tender and acts as a support for both the carriage 112 and its drive. A suitable drive motor, for example a stepping motor 182, is secured to rail 118, and a drive shaft 184 from this motor passes through the rail and carries at its free end a sprocket or pulley 186. A similar sprocket or pulley (not illustrated) is rotatably mounted in the rail at a position spaced therealong from element 186. An endless V-belt, or chain, is passed around these guide and drive elements 186, and a suitable connection (not shown) is provided between the endless element and support plate 114 of carriage 112. Motor 182 is reversible, and can drive the endless element in opposite directions to cause linear reciprocation of carriage 112 along rail 118. The superstructure carried by plate 114 has been omitted from FIG. 8.

The main frame of the tender carries a plurality of marker elements, arranged in a row parallel to the row of supports 14B on a carrier bar 52. The number of marker elements in the row corresponds to the number of supports 14B carried by the bar 52; this is indicated diagrammatically in FIG. 2 by the five marker elements M1 to M5 respectively, corresponding to the assumption of five support elements as previously discussed above. As also indicated in FIG. 2, the spacings of the marker elements M1 to M5 correspond to the spacings of the supports 14B on the bar 52. For convenience, the markers have been shown schematically in alignment with individual supports 14B, but this is not essential. The important point is that a sensor moving with the carriage 112 moves along the row of markers as the carriage 112 is moved along rail 118. This is indicated diagrammatically in FIG. 1 where reference numeral 188 indicates a structural member of the tender fixed relative to the rail 118, reference character M represents any one of the markers M1 to M5 in FIG. 2, and reference character S indicates the sensor responsive to the markers. In this case, the sensor S is assumed to be fixed to the underside of platform 110; however, it will be understood that this arrangement is adopted purely for convenience of illustration of the principles involved without interfering with illustration of other aspects of the arrangement. The physical disposition of the parts in practice can be adapted to space requirements.

FIG. 1 also indicates diagrammatically one element 190 of a sensing device, such as a light barrier (light beam emitter/receiver unit) which determines whether any bobbin tubes 10 or 46 are present at the removal location RL. The control system furthermore comprises two sensors (not shown), the first one being responsive to the return of carriage 102 to its fully retracted position, and the second sensor being responsive to return of carriage 112 to its starting position in alignment with the opening in plate 176. Strictly speaking, in the illustrated arrangement, the latter sensor is not essential, since the starting position corresponds with the marker element M3 which is sensed by the sensor S (FIG. 1). However, the positions of supports 14B along a carrier bar 52 may be variable in dependence upon the diameters of bobbin tubes to be stored in the magazine (so as to optimize utilisation of space in the magazine). However, chute 178, and the opening in plate 176, remain in fixed lateral positions relative to the tender. Accordingly, there is no necessary relationship between the chute 178 and the positions of supports 14B, and hence no necessary relationship between the starting position of carriage 112 and the supports 14B.

The control system also responds to a "bobbin presence" sensor (not shown) provided in a bobbin tube holder not specifically indicated in FIG. 1, but forming part of the bobbin tube receiving apparatus 200 at the lower end of chute 178. Further details of this apparatus, including the holder, will be provided in the description of FIGS. 9 and 10. A signal from this latter sensor represents both the start and finish of a complete bobbin tube withdrawal cycle. The complete cycle is controlled by a microprocessor (not illustrated) provided with a suitable programme and responding to the sensors referred to above. As a preliminary, if the sensor 190 indicates that all bobbin tubes have been removed from the carrier bar 52 currently located at the removal location RL, then the microprocessor will operate the drive of magazine structure 80 in order to move the next bar in succession into the removal location. Correct location of a carrier bar will be indicated by sensor 25. Drive of the chains 68, 69 will continue until sensor 190 indicates that a carrier bar 52, bearing bobbin tubes 10, or 46, has been brought into the removal location RL.

So long as a bobbin tube is present in the bobbin holder in apparatus 200, withdrawal apparatus 100 will be maintained inoperative with carriage 102 in its fully retracted position as illustrated in FIG. 1.

When the sensor in apparatus 200 indicates that the bobbin holder is empty, the microprocessor initiates operation of apparatus 100 to extract the "first" tube from carrier bar 52 at location RL. This "first" tube is assumed by the control system to be located on a specific support 14B on the carrier bar 52; it is not important which support 14B is selected to be "first", but for convenience the support on the lefthand side as viewed in FIG. 2 is assumed to be "first" in this case, as indicated by the marker designation M1. As the first step in the withdrawal operation, the microprocessor causes motor 182 (FIG. 8) to move carriage 112 until rail 104 is aligned with the first support.

When sensor S indicates that it is aligned with marker M1, the microprocessor causes pressurization of unit 106 to move carriage 102 forward on rail 104. During this movement, roller 152 rolls off curved portion 172 (FIG. 7) and is received once more in groove 170 so that gripping element 136 returns to its "ready" condition as shown in FIG. 3. After elapse of a predetermined time, which is measured by suitable timing arrangements in the software of the microprocessor and which is long enough to ensure that carriage 102 is moved to its fully extended position FIG. 6), the pressurization of unit 106 (FIG. 1) is reversed so that carriage 102 is moved back to its retracted position. If the first support 14B was actually carrying a bobbin tube, then that tube will have been gripped as described above with reference to FIGS. 3 to 6, and will be withdrawn from the magazine 80 as carriage 102 is retracted. If the first support 14B did not actually carry a bobbin tube, then the retraction step is carried out anyway, since the system has no way of "knowing" at this stage whether or not a bobbin tube has been taken up by the gripper.

As described with reference to FIG. 7, release of any tube carried by the gripper is automatic (determined by the mechanical elements of the system) as the carriage 102 approaches its retracted position. The return of the carriage to that position is sensed by the sensor referred to above, whereupon the microprocessor initiates the return (if necessary) of carriage 112 to its starting position, arrival at which is also indicated by a sensor as referred to above.

If a signal is then received from the sensor in apparatus 200 indicating arrival of a bobbin tube in the bobbin holder, then this withdrawal cycle is completed. If no such signal is received, then after elapse of a predetermined time also measured by the software of the microprocessor, a further withdrawal operation is initiated, with the carriage 102 this time being dispatched to the "second" support 14B on the carrier bar 52. The previously described withdrawal operation is then repeated and the microprocessor again waits for a signal from the sensor at the bobbin holder, indicating arrival of a tube thereat. Also, if a tube was sucessfully extracted from the magazine 80 on the first withdrawal cycle, then upon initiation of the next withdrawal cycle carriage 102 will be dispatched to the "second" support 14B instead of to the "first". The programming of the microprocessor is, therefore, such that the carriage 102 always treats the supports 14B of a newly-arrived carrier bar 52 in a predetermined order, even if there is only one bobbin tube on the carrier bar 52 which happens to be located on the support 14B which is treated last in the predetermined sequence.

The bobbin receiving apparatus 200 will now be described with reference to FIGS. 1, 9 and 10. As shown in FIG. 1, this apparatus comprises three subassemblies, namely a bobbin receiving "cage" 202, a "trapdoor" structure 204 and an operating mechanism indicated generally at 206. Individual elements of this mechanism will be described in further detail with reference to FIGS. 9 and 10. The apparatus is mounted upon the bulkhead 16 shown in FIG. 1 by means of a pair of lugs 208, only one of which is seen in FIGS. 1 and 9, but both of which appear in FIG. 10.

The cage assembly 202 comprises a front wall 210, facing the observer in FIG. 9, a corresponding rear wall (hidden behind the wall 210 in FIG. 9), and an end wall 212 (FIG. 10) joining the front and rear walls at the end thereof adjacent bulkhead 16. End wall 212 carries a pair of lugs 214, projecting therefrom towards the bulkhead 16 and pivotally mounted upon a shaft 216 which itself is rotatable in the support lugs 208. The righthand lug 214, as viewed in FIG. 10, has a downward extension forming a lever 218, the purpose of which will become clear from the subsequent description. Although not visible in the figures, cage assembly 202 also comprises a top wall, as indicated by the dotted line representation of the cross section in FIGS. 9 and 10. However, there is no bottom wall in the cage assembly, and also no end wall at the end opposite wall 212. The latter lies adjacent the lower end of slide 178.

The trapdoor assembly 204 comprises a plate 220, suspended by a pair of legs 222 from a hinge mounting 224 which is secured to a strap 226, mounted on the top wall of cage assembly 202. An arm 228, forming an operating lever, extends from the hinge mounting 224 across the top of the cage assembly 202.

The operating mechanism 206 comprises a dog-leg lever 230, a trapdoor operating lever 232 and a piston and cylinder unit 234 (illustrated only in FIG. 1). The cylinder of unit 234 is pivotally connected at one end to the bulkhead 16 by way of support 236 (FIG. 1), and the free end of a connecting rod (not specifically referenced) secured to the piston of unit 234 is pivotally connected to a pin 238 (FIG. 9 and 10) on one arm of the lever 230. The other arm of lever 230 has a lateral projection 240 which engages behind the lever 218 of cage assembly 202 for a purpose to be subsequently described. Each of levers 230 and 232 is secured to the shaft 216 for rotation therewith about the longitudinal axis of the shaft.

The apparatus 200 includes three force-generating means, only one of which (the unit 234) is illustrated. One such means is provided by a non-illustrated spiral spring acting between the shaft 216 and cage assembly 202 and urging the latter assembly to rotate in a clockwise direction (as viewed in FIG. 9) about the shaft axis. This rotation of cage assembly 202 can be limited by the projection 240 on lever 230 if the latter engages lever 218 on the cage assembly. If there is no such engagement, then the limit to clockwise rotation of cage assembly 202 on shaft 216 is provided by engagement between an abutment 242 at the lower end of lever 218 with a corresponding abutment 244 (FIG. 9) secured to the bulkhead 16. The cage assembly 202 is thus prevented by the abutment 244 from passing significantly beyond the horizontal disposition illustrated in FIG. 9 in a clockwise direction around shaft 216.

A second non-illustrated force-generating means is in the form of a tension spring acting between the bulkhead 16 and the arm of lever 230, acted upon by unit 234. This spring tends to rotate lever 230 in an anti-clockwise direction (as viewed in FIG. 9) about the axis of shaft 216. Accordingly, ignoring for the present the action of unit 234, the tension spring tends to urge projection 240 on lever 230 into engagement with lever 218 of the cage assembly 202. The turning moment exerted on assembly 202 by the tension spring acting through lever 230 is greater than the opposing turning moment exerted on the assembly 202 by the spiral spring. Accordingly, as illustrated in FIG. 9, the tension spring draws abutment 242 away from abutment 244. Normally, however, the turning moment exerted by the tension spring is itself counteracted by pressurization of unit 234, so that the apparatus 200 is held in the condition illustrated in FIG. 9, in which cage assembly 202 is approximately horizontal.

So long as projection 240 remains in contact with lever 218, lever 232 will remain out of contact with arm 228, as illustrated in FIG. 9. The weight distribution of the trapdoor assembly 204 is then such that plate 220 is swung about the hinge mounting 224 to a position beneath cage assembly 202, as best illustrated in FIG. 10. The combination of the cage assembly 202 and plate 220 then acts as the bobbin tube holder referred to in the previous description, with the tube resting on plate 220, being located at one end against end wall 212 and being laterally confined by the side walls of the cage assembly 202.

If, now, the pressurization of unit 234 is increased in a sense tending to extend the unit, then lever 230 is rotated in a clockwise direction (as viewed in FIG. 9) about the axis of shaft 216, against the bias supplied by the non-illustrated tension spring. As soon as abutment 242 comes into contact with abutment 244 (FIG. 9), projection 240 pivots away from lever 218, and lever 232 comes into contact with operating arm 228. The trapdoor mechanism 204 is therefore pivoted in an anti-clockwise direction (as viewed in FIG. 10) about the hinge mounting 224, so that plate 220 swings away from the open lower side of cage assembly 202. Any bobbin tube previously confined within the cage assembly is therefore free to drop into a bobbin receiver arranged below that assembly. Such a receiver may, for example, be formed in accordance with the arrangement shown in FIG. 5 of published European Patent Application No. 126352, although any alternative form of bobbin receiver can be used instead.

When the additional pressurization of unit 234 is cancelled, the system will return to the condition illustrated in FIGS. 9 and 10. However, the non-illustrated sensor referred to in the previous description as associated with the bobbin holder, will now indicate to the microprocessor that the bobbin holder is empty and the microprocessor will accordingly initiate a bobbin tube withdrawal cycle as previously described. The bobbin holder must therefore be tilted from the horizontal disposition illustrated in FIGS. 9 and 10 to an inclined disposition, in which it forms an extension of the slide 178, in order to receive the incoming tube.

Tilting of the bobbin holder to the bobbin receiving disposition is effected by cancelling the pressurization of unit 234 tending to extend that unit. The previously-mentioned tension spring acting on lever 230 is therefore no longer counteracted, and this lever rotates in an anti-clockwise direction (as viewed in FIG. 9) about the axis of shaft 216. This automatically carries along the cage assembly 202 (and the trapdoor assembly 204 mounted thereon) because of the engagement of projection 240 with lever 218.

When the sensor indicates that a fresh bobbin tube has been received by the bobbin holder, the previous, normal pressurization of unit 234 is reestablished to return apparatus 200 to the condition illustrated in FIGS. 9 and 10. The apparatus remains in this condition until the microprocessor again causes additional, extending pressurization of the unit 234 to open the bobbin holder and release the tube therein as previously described. Generation of signals causing the release operation will not be described in the present application since it forms no part of the present invention. Arrangements for generating such signals can be found, by way of example, in the embodiments described in the previously mentioned European Patent Application No. 126352.

As indicated in dotted lines in FIG. 9, the angle of inclination of slide 178 may vary in dependence upon the tubes to be handled. Suitable stop means, not shown, may be provided to limit tilting of the bobbin holder accordingly.

MODIFICATIONS

The invention is not limited to details of the embodiments illustrated in the drawings. In particular, it is not limited to use with a magazine structure such as that illustrated at 80 in FIG. 1. While the invention is clearly most useful where the magazine structure exerts a retaining force upon a bobbin tube stored therein, this is not essential. Thus, the invention could be applied also to a magazine structure of the type shown in FIG. 1 of German published Patent Application No. 3241032, where at least part of an outer end of a tube at a removal location is also accessible for gripping by a removal device.

While the arrangement is preferably such that relative movement is possible between tube supports of the magazine and the withdrawal device, in order selectively to bring the withdrawal device into operative alignment with any one of a plurality of supports, the modes of relative movement may be radically different to those shown in FIG. 1. The tube supports could be arranged in a fixed array and means could be provided to move the withdrawal device relative to the array to bring it into operative alignment with a selected tube support. It is also conceivable that the withdrawal device could be in a fixed disposition, and the tube supports could be moved to bring them into operative alignment therewith. The illustrated arrangement, involving predetermined movements of both the tube supports and the withdrawal device, provides a convenient compromise.

The invention is not limited to the use of a single withdrawal device. There could, for example, be a plurality of withdrawal devices for cooperation with respective tube supports. However, unless tubes are likely to be demanded at a very high rate, which cannot be satisfied by a single withdrawal device, the additional complexity of plural withdrawal devices simply adds to costs and control problems. If a plurality of withdrawal devices is provided, then they may be arranged to withdraw tubes simultaneously or individually from the magazine structure. In any event, the arrangement is preferably such that the tubes are supplied in succession to a transfer means, such as the chute 178 in FIG. 1.

The illustrated transfer arrangement and bobbin receiving equipment is also not essential. Alternative arrangements, involving transfer of bobbin tubes to individual pockets of a conveyer arrangement are shown in German published Patent Application No. 3241032, and they can also be used as a substitute for the receiving plate 176, chute 178 and apparatus 200 shown in FIG. 1. However, the arrangement shown in the German Application would be more suitable in the case of a stationary installation, delivering bobbin tubes to a service tender on a machine, than in equipment to be provided on the service tender itself, where weight and space limitations usually rule out complex structures.

Where only a single withdrawal device is provided, a more complex control system could be provided to reduce the risk of "redundant" withdrawal operations, where there is no bobbin tube on the support in operative alignment with the withdrawal device. For example, a more complex sensing arrangement could be provided to indicate to the microprocessor which tube supports (if any) on a bar 52 newly brought into the removal location RL are actutally carrying bobbin tubes. It must be borne in mind, however, that this system must be adaptable with the adaptation of the magazine structure itself to storing different bobbin tube types, and the programming of the microprocessor must be correspondingly adjustable. This additional complexity will usually not be warranted, since the time lost by the withdrawal device in "hunting" for a bobbin tube will not usually prevent delivery of that bobbin tube to the apparatus 200 well before the subsequent tube using system demands delivery of a fresh bobbin tube from that apparatus.

The gripping carriage 102 has been deliberately designed to apply and release gripping force in response to mechanical engagement dependent upon the position of the carriage along its guide rail 104. Clearly, here also, a more complex control and operating system could be applied. For example, a selectively operable gripper opening and closing mechanism could be used, possibly operated by a piston and cylinder unit or an electromagnetically operated device. A control system could be provided to close the gripping elements upon a tube when the carriage is appropriately located relative to the magazine structure 80, and to open the gripping elements to release the tube when the latter has been withdrawn from the magazine structure. The illustrated arrangement has the advantage of relative simplicity, whilst still being adaptable to cope with a wide range of different bobbin tubes.

The "eccentrically mounted" gripper shoes 132 are not essential features; the gripping action could be applied between element 136 and nose 124, with the gripping force being dependent solely upon the action of tension spring 146 in FIG. 3. However, the illustrated arrangement reduces the risk of damage to the tube edge by facilitating easy insertion of the tube into the nip while strongly resisting movement of the tube back out of the nip until the gripping action is released. The arrangement can be adapted even to accept a bobbin tube 10 with a curled back end as shown in dotted lines at the lower edge of tube 10 in FIG. 6.

The arrangements for moving an extracted tube to the transfer means (chute 178) are also not essential to the invention. If the system is to be used only with cylindrical tubes, which can be relied upon to roll in a predictable fashion, then movement of a tube extracted from the outer tube supports to the central opening in plate 176 (FIG. 1) may be effected simply by inclining the plate downwardly from both sides towards the opening. Alternatively, a tube pushing device, operable independently of the gripping device, may be associated with the plate 176 to move an extracted tube to the transfer means.

A bobbin tube extracting device in accordance with the invention applies a gripping force to a bobbin tube by engaging it both internally and externally of the tube. Accordingly, it is essential that an end of the tube be accessible to enable insertion of a gripping element into the tube. It is not, however, essential that the extraction operation involves movement of the tube longitudinally of its own axis. For example, Japanese published Patent Application No. 59-33865, published 2 Mar. 1984 (original Application No. 57-127148) shows a bobbin tube gripping device engaging the external surface only of a bobbin tube and extracting the tube from a magazine by movement in a direction at right angles to the tube axis. The gripping head on this arrangement could be modified to bring it into accordance with the present invention by providing an element movable on the bobbin extracting arm to engage within the interior of a bobbin tube contacted by the arm on its exterior. The extraction movement could still involve a swinging movement of the arm to move the bobbin tube at right angles to its own axis.

The gripping elements, shoes 132 and the gripping section 158, illustrated in FIG. 1, are substantially rigid. This is not essential. Means could be provided to apply gripping pressure by way of resilient elements, and the resilience may be dependent upon the material and form of the elements or upon the mode of operation of the gripping device. For example, each gripping element could include a resiliently expandable portion, operated for example by pressure fluid such as air, to apply a gripping pressure when expanded. This would obviously complicate the structure, however, since it would be necessary to provide a suitable air supply to the movable carriage.

The gripping device may be arranged to contact the external surface of the bobbin tube at only a single contact zone thereon, i.e., may be provided with only a single external gripper element. The internal and external gripping elements are then preferably disposed radially opposite each other relative to the tube. The gripper device can also be arranged to contact the internal surface of the bobbin tube at a plurality of contact zones spaced around the tube axis, i.e., there may be a plurality of internal gripping elements. One or more external gripping elements may be arranged to cooperate with a plurality of internal gripping elements.

As indicated above, the illustrated embodiment is intended particularly for use in a service tender movable relative to a serviced machine. This is not essential, however. Arrangements in accordance with the invention are capable of use in stationary bobbin tube handling systems.

It is a feature of the gripper that its action is substantially independent of the diameter of the tube to be gripped. For this purpose, it is necessary to limit the arc over which the gripper can contact the gripped tube. If this arc subtends an angle of more than about 90° at the longitudinal axis of the tube, then the action of the gripper will be dependent upon the tube diameter. Preferably, this arc subtends no more than 30°–40° at the tube axis.

On the other hand, a very limited arc of contact can lead to instability in the location of the tube relative to the gripper while the tube is carried by the gripper jaws. Preferably, therefore, the minimum arc of contact lies in the range 10° to 20°. This arc will in practice be dependent upon the diameter of the tube being gripped. Contact between the gripper jaws and the tube is not necessarily continuous over this arc. The arc is defined by the outer limits of contact.

Independence of the tube diameter enables use of a single gripper to handle tubes of widely varying diameter at the accessible end. For example, the same gripper can deal with both conical and cylindrical tubes where the difference in tube diameter at the end presented to the gripper is of the order of 1:2.

It is a requirement that a tube to be gripped presents an accessible end edge to the gripper, but it is not necessary that this edge should be accessible around the complete circumference of the tube end. In order to ensure maximum possible packing density in the magazine, adjacent tube ends may contact each other or the spacing between adjacent tubes may be so small that insertion of a gripping element between their region of closest approach may be impossible.

Even where a plurality of grippers are provided in combination with one magazine, the grippers are preferably operable individually (separately from each other). This simplifies the problems of dealing with mislocation of the tube ends to be gripped. For example where tube diameter at the accessible end can lie in the range 30 to 70 mm, a positional tolerance of the tube axis of ±5 mm may have to be allowed.

The gripper is preferably of the illustrated type in which the gripper elements are biased towards the gripping positions. There is then no need for a control operation, e.g. pressurisation, to effect gripping. Furthermore, the release step can be carried out at a predetermined stage of the return movement of the gripper (after the tube has been fully withdrawn from the magazine) and the gripper can adopt its "ready" condition at the same point on its forward movement towards the magazine.

A retaining force in the range 1 to 3 Newtons will generally be adequate to maintain the tubes in place in the magazine, even as the tubes pass around the lower end of a vertically extending conveying path. This force must of course be overcome by the gripper in withdrawing a tube from the magazine.

What is claimed is:

1. A gripper for extracting a bobbin tube from a magazine comprising a body having a plurality of rollers for reciprocating movement on rails;

at least a first gripper element pivotally mounted on said body between a gripping position for entry into a bobbin tube on a magazine and a bobbin tube releasing position, said element having serrations for gripping an interior surface of a bobbin in said gripping position;

at least a second gripper element pivotally mounted on said body for engaging an outer surface of the bobbin tube; and resilient means urging said elements towards each other while an accessible peripheral portion of a bobbin tube is guided into a nip therebetween.

2. A gripper as set forth in claim 1 which further comprises a nose projecting from said body in spaced relation to said first gripper element to engage an outside surface of a bobbin being gripped between said gripper elements.

3. An apparatus for extracting bobbin tubes from a magazine comprising a gripper including a body, an inner gripper element pivotally mounted on said body between a gripping position for entry into an open end bobbin tube on a magazine eccentrically of a longitudinal axis of the bobbin tube and a bobbin tube releasing position; at least an outer gripping element mounted on said body in spaced relation to said inner gripping element in said gripping position to define a nip therebetween for gripping of the bobbin tube therein, said outer gripping element having a tapered surface; and resilient means urging said inner element toward said outer element without pivoting away during a gripping operation to grip a peripheral portion of the bobbin tube with therebetween said inner gripping element spaced from the remaining peripheral portions of the bobbin;

means for moving said gripper between a first position to grip a bobbin thereat and a second position;

means to pivot said inner gripping element away from said outer gripping element to release a gripped bobbin during movement of said gripper from said first position to said second position;

a platform; and a rail pivotally mounted at one end on said platform, said rail having said gripper mounted thereon for movement between said positions with said tapered surface of said outer gripping element engaging an outer surface of a bobbin tube during pivoting of said rail and said gripper on said platform.

4. An apparatus as set forth in claim 3 which further comprises a bobbin tube receiving means for receiving a bobbin tube from said gripper during movement of said gripper to said second position.

5. A gripper for extracting a bobbin tube from a magazine comprising a body having a plurality of rollers for riding on rails;

at least a first gripper element mounted on said body, said element including a mounting portion on said body and a gripping section adjustably mounted on said mounting portion for entry into a bobbin tube on a magazine;

at least a second gripper element mounted on said body for engaging an outer surface of the bobbin tube;

resilient means urging said elements towards each other to grip an accessible peripheral portion of a bobbin tube therebetween with said first gripper element spaced from the remaining peripheral portions of the bobbin tube; and a plurality of removably mounted washers between said mounting portion and said gripping section of said first gripper element for adjusting a gap between said gripper elements to a thickness of a bobbin to be gripped.

6. A gripper as set forth in claim 5 wherein said first gripper element is pivotally mounted on said body and includes serrations for gripping an interior surface of a bobbin.

7. A gripper as set forth in claim 6 wherein said second griper element is pivotally mounted on said body.

8. A gripper as set forth in claim 6 which further comprises a nose projecting from said body in spaced relation to said first gripper element to engage an outside surface of a bobbin being gripped between said gripping elements.

9. A gripper for extracting a bobbin tube from a magazine comprising a body having a pair of rollers on one side for riding on a rail;

a forwardly projecting nose extending from said body;

at least one gripping element pivotally mounted on said nose for engaging an external surface of a bobbin tube;

a second gripping element pivotally mounted on said body for engaging an internal surface of a bobbin tube; and resilient means urging said second element towards said one gripping element to grip a bobbin tube therebetween while the bobbin tube is guided into a nip defined between said gripping elements.

10. A gripper as set forth in claim 9 wherein said one gripping element pivots on said body during guiding of a bobbin tube into said nip between said gripping elements in a direction to increase said nip.

11. A gripper for extracting a bobbin tube from a magazine comprising a body having a plurality of rollers for reciprocating movement on rails;

at least a first gripper element pivotally mounted on said body between a gripping position for entry into a bobbin tube on a magazine and a bobbin tube releasing position, said element having serrations for gripping an interior surface of a bobbin in said gripping position;

at least a shoe pivotally mounted on said body for engaging an outer portion of the bobbin tube between said shoe and said first gripper element; and resilient means urging said element and said shoe towards each other while an accessible peripheral portion of a bobbin tube is guided into a nip therebetween.

12. A gripper as set forth in claim 11 which further comprises a nose projecting from said body in spaced relation to said first gripper element to engage an outside surface of a bobbin being gripped between said gripping element and said shoe.

* * * * *

UNITED STATES PATENT AND TRADEMARK OFFICE

CERTIFICATE OF CORRECTION

PATENT NO. : 5,036,967

DATED : August 6, 1991

INVENTOR(S) : WERNER GRABER,
GUNTER GARTNER

It is certified that error appears in the above-identified patent and that said Letters Patent is hereby corrected as shown below:

Column 1, line 65 change "mean" to -means-
Column 2, line 40 change "in" to -in Fig. 1.-

Column 5, line 51 change "cf" to -of-
Column 6, line 38 change "botbin" to -bobbin-
Column 11, line 62 change "Fig. 6)," to -(Fig. 6),-
Column 17, line 36 change "20. " to -20.- (Delete BOLD)
Column 19, line 29 change "griper" to -gripper- Signed and Sealed this Tenth Day of August, 1993

*Attest:*

Michael K. Kirk

MICHAEL K. KIRK

*Attesting Officer*

*Acting Commissioner of Patents and Trademarks*